US007841550B1

(12) United States Patent
Dorsch et al.

(10) Patent No.: US 7,841,550 B1
(45) Date of Patent: Nov. 30, 2010

(54) CUTTER NUT AND CUTTER BAR ASSEMBLY

(75) Inventors: Glenn Robert Dorsch, Aberdeen, WA (US); Kent Harrison Keeran, Elma, WA (US); Yee Chung Chak, Hoquiam, WA (US)

(73) Assignee: Vaughan Co., Inc., Montesano, WA (US)

( * ) Notice: Subject to any disclaimer, the term of this patent is extended or adjusted under 35 U.S.C. 154(b) by 468 days.

(21) Appl. No.: 11/986,209

(22) Filed: Nov. 20, 2007

(51) Int. Cl.
*B02C 19/00* (2006.01)

(52) U.S. Cl. ..... 241/46.017; 241/46.06

(58) Field of Classification Search ..... 241/46.08, 241/46.017, 46.06; 415/121.1
See application file for complete search history.

(56) References Cited

U.S. PATENT DOCUMENTS 3,973,866 A 8/1976 Vaughan
4,842,479 A 6/1989 Dorsch
5,076,757 A 12/1991 Dorsch
5,256,032 A 10/1993 Dorsch
5,456,580 A 10/1995 Dorsch
5,460,482 A 10/1995 Dorsch
5,460,483 A 10/1995 Dorsch
6,224,331 B1 * 5/2001 Hayward et al. ..... 415/121.1
7,125,221 B2 * 10/2006 Dorsch et al. ..... 415/121.1

FOREIGN PATENT DOCUMENTS

WO WO 2006/058605 A1 * 6/2006

* cited by examiner

*Primary Examiner*—Dana Ross
*Assistant Examiner*—Matthew G Katcoff
(74) *Attorney, Agent, or Firm*—Bishop & Diehl, Ltd.

(57) ABSTRACT

A cutting assembly for positioning at the intake end of a centrifugal pump used for pumping liquids and slurries containing solid matter, including various types of refuse, and for chopping the solid matter which may thereafter be processed for disposal is disclosed. The cutting assembly includes an intake end plate having a body defining the opening to allow the passage of material, such as waste water and the like, therethrough. The intake end plate attaches at the intake end of the chopper pump. The assembly also includes at least one, and preferably a plurality of cutter bars projecting from the body of the intake end plate into the opening, and a nut positioned at the intake end and attached to the chopper pump within the opening of the intake end plate. Preferably, the nut comprises at least one raised cutting projection having a cutting edge formed at a junction between a first surface and an adjacent second surface, the cutting edge of the raised cutting projection providing aggressive cutting action in coordination with the cutter bars.

23 Claims, 6 Drawing Sheets

CUTTER NUT AND CUTTER BAR ASSEMBLY

TECHNICAL FIELD OF THE INVENTION

The present device relates to the general field of centrifugal pumps. More specifically, the device relates to centrifugal pumps used for pumping liquids and slurries containing solid matter, including various types of refuse, and for chopping the solid matter which may thereafter be processed for disposal.

BACKGROUND OF THE INVENTION

Generally speaking, U.S. Pat. No. 3,155,046 to Vaughan, issued Nov. 3, 1964, discloses a centrifugal pump having an open impeller with radial vanes. The vane edges adjacent to the pump inlet cooperate with sharpened edges of inlet apertures to cut stringy material or chunks entering the pump. Similarly, U.S. Pat. No. 3,973,866 to Vaughan, issued Aug. 10, 1976, and U.S. Pat. No. 4,842,479 to Dorsch, issued Jun. 27, 1989, disclose centrifugal pumps having impellers with vanes cooperating with inlet apertures to achieve a chopping or slicing action of solid material in a liquid or slurry being pumped. In the case of the pumps of U.S. Pat. No. 3,973,866 to Vaughan and U.S. Pat. No. 4,842,479 to Dorsch, however, semi-open impellers having radial shroud plates are used; and external booster propellers are provided to accelerate flow into the pump, to displace chunks of solid matter which become lodged in the inlet apertures and, at least in some instances, to cut solid matter prior to entry into the pump.

Other types of pumps having external cutters rotated with an impeller or propeller are shown in U.S. Pat. No. 2,714,354 to Farrand, issued Aug. 2, 1955; U.S. Pat. No. 3,325,107 to Peterson, issued Jun. 13, 1967; and French Patent No. 1.323.707, issued Mar. 1, 1962. U.S. Pat. No. 3,444,818 to Sutton, issued May 20, 1969, discloses another type of centrifugal pump having an internal impeller with vanes cooperating with the periphery of an inlet aperture to achieve a slicing action. In the Sutton construction, an outer "chopper member" has blades that wipe across the outer surface of the apertured intake plate to assist in chopping solid material to a size small enough to enter the intake aperture. Similarly, in the construction shown in British Patent No. 1,551,918, published Sep. 5, 1979, external blades sweep across small intake apertures to dislodge or gradually cut solid material clogging an intake aperture. In both the construction shown in the Sutton patent and the construction shown in the British patent, the external member is mounted so as to be moveable axially away from the intake plate if a hard obstruction is encountered.

Other types of pumps designed for pumping liquids or slurries containing solid materials are disclosed in Canadian Patent No. 729,917, issued Mar. 15, 1966; Schlesiger U.S. Pat. No. 3,340,812, issued Sep. 12, 1967; Elliott U.S. Pat. No. 4,527,947, issued Jul. 9, 1985; and Corkill U.S. Pat. No. 4,575,308, issued Mar. 11, 1986.

One of the problems in all these devices is the wear on the cutting parts over time. Fibrous material, such as hair and the like, tend to accumulate in the cutting area, particularly at the cutting parts. The fibrous material collects grit and sand causing the cutting parts to grind down prematurely. A cutter nut and cutter bar assembly at the pump intake has been used to keep the cutting parts clear of such fiber and debris.

Perhaps the most closely related device for this purpose is shown in U.S. Pat. No. 5,460,483 to Dorsch, issued Oct. 24, 1995. The Dorsch '483 patent illustrates a square cutter nut projection (60) in FIG. 12. FIG. 15 of Dorsch '483 better illustrates the cutting operation of the projection (60) as it passes fingers (41). However, such a configuration is not nearly as aggressive as the invention of the present disclosure.

It is therefore desirable to provide a cutter assembly which helps maintain a clear cutting area and reduces cutting part wear. It also would be desirable to provide a cutter assembly which aggressively reduces the build-up and collection of grit in the cutting area. The disclosed device affords other structural, manufacture and operating efficiencies not seen in prior art devices, as well.

SUMMARY OF THE INVENTION

There is disclosed herein a cutting assembly for a chopper pump having an intake opening. Generally, the cutting assembly comprises an intake end plate, at least one each of a toothed cutter bars and a toothed cutter nut.

In an embodiment of the assembly, the intake end plate has a body defining the opening to allow the passage of material, such as waste water and the like, therethrough. The intake end plate attaches at the intake end of the chopper pump. The cutter bar projects from the body of the intake end plate into the opening, and the nut is positioned at the intake end and attaches to the chopper pump within the opening of the intake end plate. Preferably, the nut comprises at least one raised cutting projection (i.e., a tooth) having a cutting edge formed at a junction between a first surface and an adjacent second surface, the cutting edge of the raised cutting projection providing cutting action in coordination with the cutter bar.

In another embodiment, the assembly further comprises a cutting edge on an end of the cutter bar, wherein the cutting edge of each cutter bar is formed at a junction between a first surface and an adjacent second surface. The cutting edge of the cutter bar provides cutting action in coordination with the cutting edge of the at least one raised cutting projection of the cutter nut.

In a particular embodiment, the nut comprises a single raised cutting projection. However, two or more raised cutting projections may be used in alternative embodiments. The first surface and the adjacent second surface of the raised cutting projection preferably form an angle within the range of 15 to 80 degrees, most preferably in the range of 30 to 60 degrees. The first surface and the adjacent second surface of each cutter bar preferably form an angle within the range of 15 to 80 degrees, most preferably in the range of 30 to 60 degrees.

In still another particular embodiment, the first surface of the raised cutting projection and of each cutter bar is curved, that is, concave. Alternatively, the first surface of each may be straight and may or may not culminate at its base in a radius. The cutting edge of each cutter bar is preferably positioned such that each faces in the same direction and the cutting edge of the raised cutting projection faces an opposite direction such that the cutting edge of the projection faces the cutting edge of each cutter bar during operation.

These and other aspects of the invention may be understood more readily from the following description and the appended drawings.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF PREFERRED EMBODIMENTS

Figure 1:
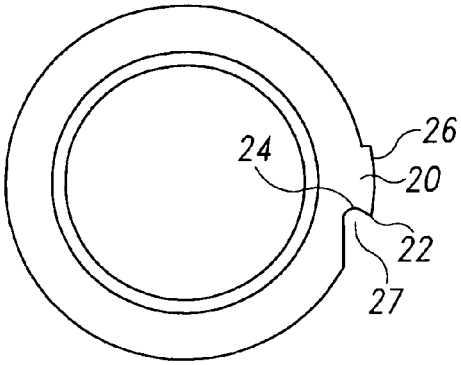
FIGS. 1 and 2 illustrate a single-toothed embodiment of a cutter nut in accordance with the present disclosure.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to embodiments illustrated.

Referring to FIGS. 1-12, there is illustrated multiple embodiments of a cutting assembly, generally indicated with the numeral 10, for the intake end of a chopper pump (not shown). A particularly suitable chopper pump is described in greater detail in U.S. Pat. No. 5,460,483 to Dorsch, and assigned to Vaughan Co, Inc., the assignee of the present invention. To the extent necessary for understanding the structure and operation of a chopper pump, the '483 Dorsch patent is hereby incorporated by reference.

Generally speaking, the cutting assembly 10 is comprised of a cutter nut 12 and a cutter bar 14. The cutter nut 12 and cutter bar 14 are positioned at the inlet end of the chopper pump and function to reduce solid debris before it enters the chopper pump. The reduction of material at the intake prevents detrimental build-up of grit and the like in the chopping blades of the pump. The two components are equipped with aggressive cutting teeth which operate in unison to sheer material at the intake.

Figure 2:
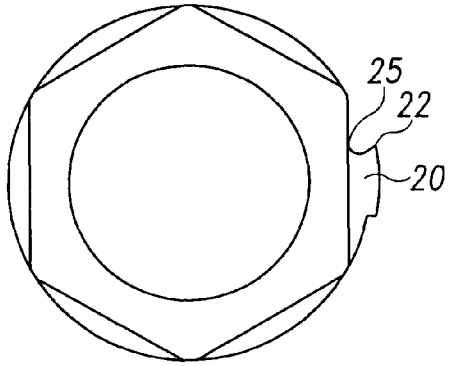
Figure 3:
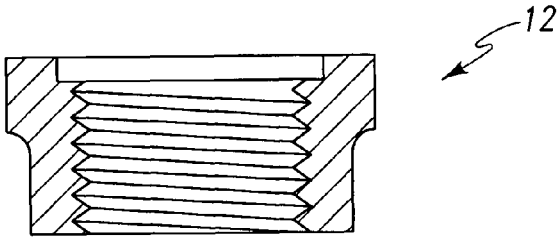
FIG. 3 is a cross-section of a cutter nut of the present invention.

FIGS. 1-3 illustrate a single-toothed embodiment of the cutter nut 12. The cutter tooth 20 is a raised projection along the periphery of the cutter nut 12. However, more than a mere raised projection, the cutter tooth 20 has a sharp cutting edge 22 formed at the junction between a first surface 24 and a second surface 26. The two surfaces form an angle (β) within the range of between 15 and 80 degrees, preferably between 30 and 60 degrees.

Figure 4:
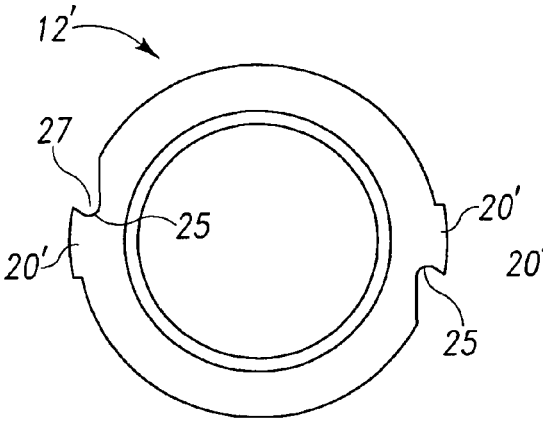
FIGS. 4 and 5 illustrate a double-toothed embodiment of a cutter nut in accordance with the present disclosure.
Figure 5:
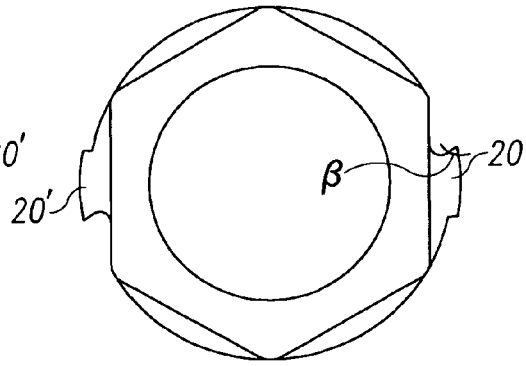

FIGS. 4 and 5 illustrate a double-toothed embodiment of the cutter nut 12'. The two cutter teeth 20' are balanced about the periphery of the cutter nut 12'. Additional cutter teeth, if necessary, would be similarly spaced about the cutter nut.

In both embodiments, the first surface 24 of the tooth 20, 20' is undercut at a straight angle of 60 degrees. The surface 24 meets the root 25 of the cutter nut 12 in a radius of 0.06". The radius of the root 25 occurs below the projected periphery of the cutter nut 12 to create recessed area 26. Also as shown, the second surface 26 preferably matches the contour of the cutter nut 12 periphery. The recessed area 27 and the aggressive angle of each tooth 20, 20' greatly improve the effectiveness of the cutting assembly 10.

Figure 6:
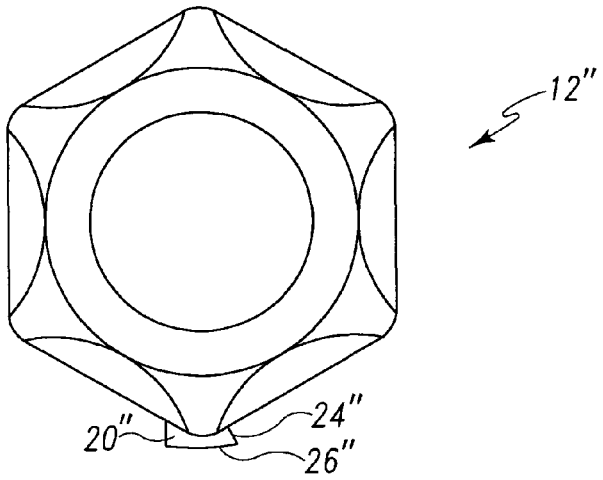
FIGS. 6, 7 and 8 illustrate another single-toothed embodiment of a cutter nut in accordance with the present disclosure.
Figure 8:
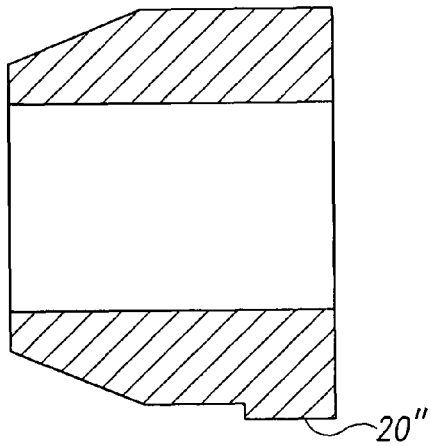
Figure 7:
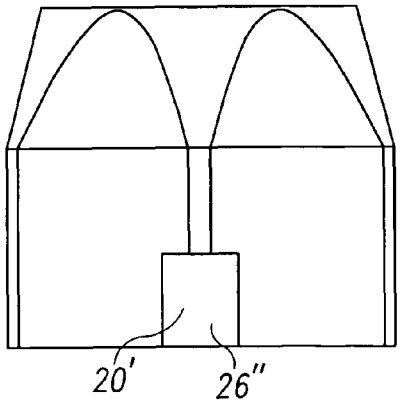

Referring to FIGS. 6-8, a second embodiment of the raised projection cutter tooth 20" is shown. The cutter tooth 20" of this embodiment lacks the recessed area adjacent the first surface 24". The first surface 24" is cut at a straight angle of about 60 degrees. However, the aggressiveness of the cutter nut 12" is maintained by the positioning of the cutter tooth 20" at the point of the nut—the previous embodiment was aligned with the flat of the nut. Though only a single cutter tooth is shown, two or more cutter teeth are possible, as with the previously described embodiment.

Figure 9:
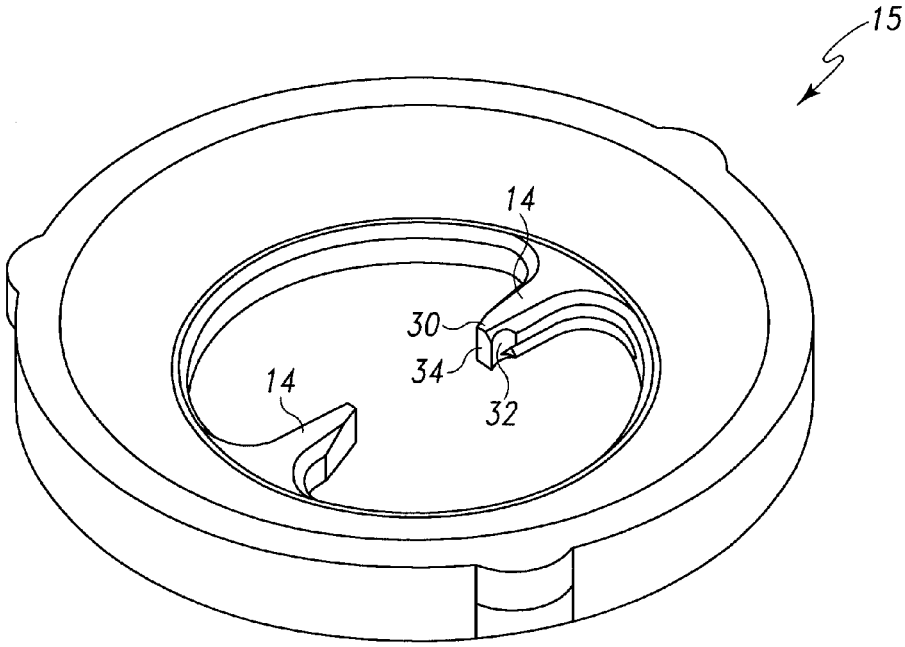
FIG. 9 is a perspective view of one embodiment of a cutter bar in accordance with the present disclosure.
Figure 10:
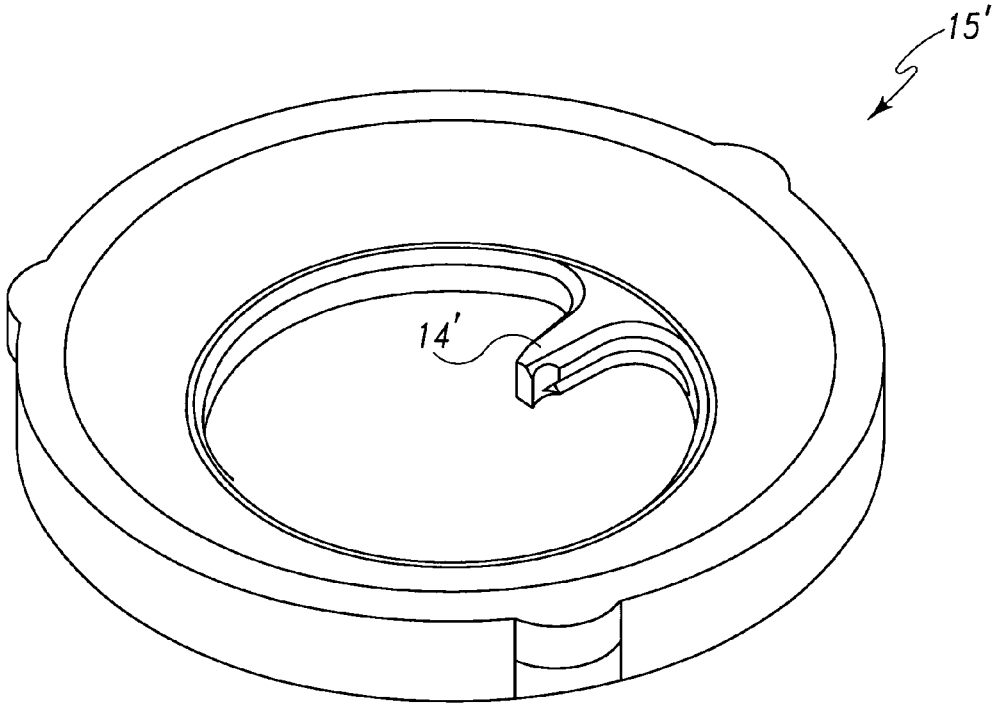
FIG. 10 is a perspective view of another embodiment of a cutter bar in accordance with the present disclosure.

FIG. 9 illustrates a first embodiment of an intake end plate 15 having two cutter bar projections 14. FIG. 10 shows an embodiment having a single cutter bar projection 14'. Naturally, additional cutter bars 14, 14' are possible, if desired. End plates having as many as six (6) cutter bars have been successfully implemented. The end plate 15 comprises an opening, the cutter bars 14 extending into the opening a distance. The cutter nut 12 attaches to the chopper pump positioned within the opening of the intake end plate 15.

The cutter bars 14, 14' are equipped with cutting teeth 30, similar to those of the cutter nut. In each embodiment the cutter bar 14, 14' has a first surface 32 undercutting a second surface 34 at an approximate 45 degrees, but is preferably a curved surface. Actually, the first surface 32 approximates a 45 degree angle, but because the most effective cutting tool has a cutting diameter, the surface 32 is preferably curved. An end mill is used to cut a radius in the surface to create a hook-like member (shown best in FIG. 12) in the cutter bar 14, 14' end. It has been found that while this is a cost effective means for producing the cutting tooth 30, the hook member adds another level of aggressiveness to the cutter bar 14, 14'. The cut radius of surface 32 by the end mill may be in a range which approximates a 15 to 60 degree straight angle, though 45 degrees is preferred. Alternatively, the surface may actually be cut at a straight angle within the range of 15 to 80 degrees, most preferably 30 to 60 degrees.

Figure 11:
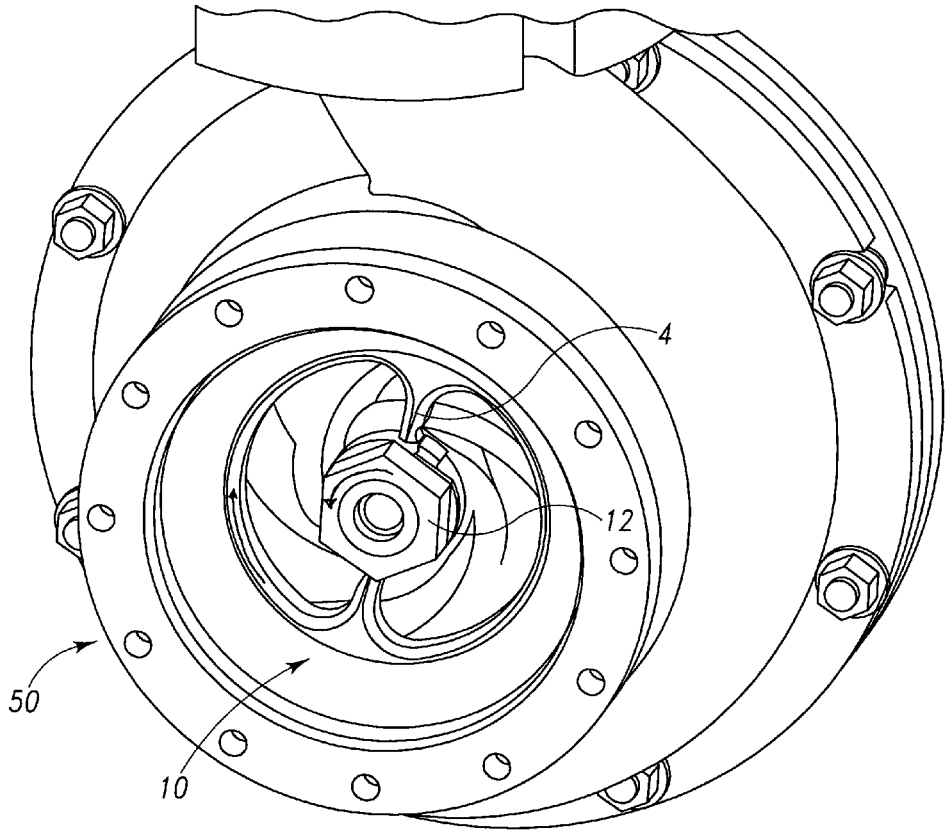
FIG. 11 illustrates an embodiment of the disclosed assembly.

FIG. 11 better illustrates the positioning of the cutter nut 12 within the opening of the intake end plate 15 at the intake end 50 of the chopper pump. When the cutting assembly 10 is attached to the chopper pump, the cutting teeth (or tooth) 30 of the cutter bars 14 are faced opposite the tooth (or teeth) 20 of the cutter nut 12.

Figure 12:
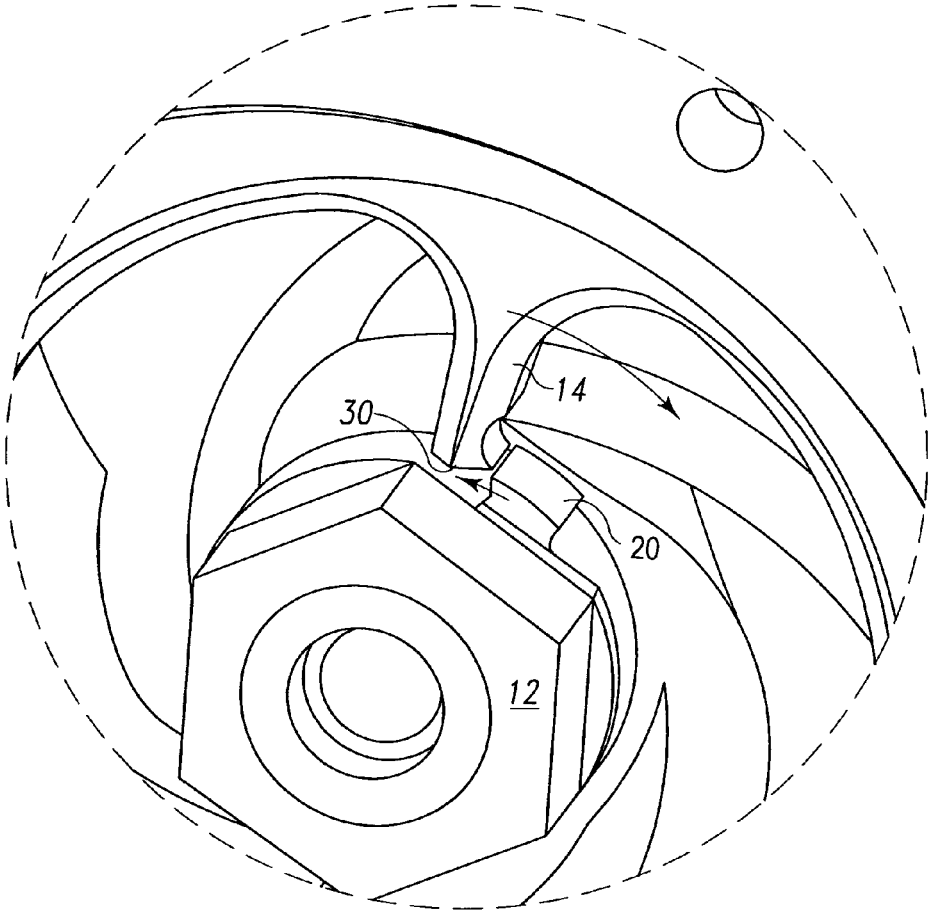
FIG. 12 illustrates a close up of the assembly shown in FIG. 11.

FIG. 12, a close-up of the assembly 10 in FIG. 11, illustrates the cooperation between a cutter nut tooth 20 and a cutter bar tooth 30 as the two pass in opposite directions (see arrows). A more aggressive cutting action is provided by the toothed projections 12 and 14 over the prior art.

For example, two trials were conducted on parts using the pump as described in the '483 Dorsch patent. In each trial, the parts had to be replaced after approximately six (6) weeks of continuous operation. Experimental testing on the present design has completely unexpectedly yielded parts lasting almost nine (9) times longer. That is, the lifespan of chopper pump parts incorporating the present design need replacement only about once a year rather than about eight (8) times a year. The cost savings, even considering the added expense of machining the present parts, is considerable. The more aggressive cutting system clearly leads to parts having substantially longer life cycles than those presently in use.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A cutting assembly for a chopper pump having an intake end, the assembly comprising:

an intake end plate having a body defining an opening to allow the passage of material there through, wherein the intake end plate attaches at the intake end of the chopper pump;

at least one cutter bar projecting from the body of the intake end plate into the opening defined by the body of the intake end plate;

an impeller having a plurality of impeller blades positioned adjacent the at least one cutter bar of the intake end plate; and, a nut positioned within the opening of the intake end plate;

wherein the nut comprises at least one raised cutting projection having a cutting edge formed at a junction between a first surface and an adjacent second surface, the cutting edge of the raised cutting projection providing cutting action in coordination with the at least one cutter bar.

2. The assembly of claim 1, further comprising a cutting edge on an end of each of the at least one cutter bars, wherein the cutting edge of each cutter bar is formed at a junction between a first surface and an adjacent second surface, the cutting edge of the cutter bar providing cutting action in coordination with the cutting edge of the at least one raised cutting projection.

3. The assembly of claim 1, wherein the nut comprises a single raised projection.

4. The assembly of claim 1, wherein the first surface and the adjacent second surface of the raised cutting projection form an angle within the range of 15 to 60 degrees.

5. The assembly of claim 2, wherein the first surface of the cutter bars is curved.

6. The assembly of claim 5, wherein the curve of the first surface of each cutter bar is cut to approximate an angle with the adjacent second surface of each cutter bar within the range of 15 to 60 degrees.

7. The assembly of claim 4, wherein the first surface of the raised cutting projection is curved.

8. The assembly of claim 6, wherein the angle approximated by the curve of the first surface of each cutter bar is about 45 degrees.

9. The assembly of claim 7, wherein the curve of the first surface is concave relative to the raised cutting projection.

10. The assembly of claim 8, wherein the curve of the first surface is concave relative to the cutting bar.

11. The assembly of claim 1, further comprising a recessed area adjacent the first surface.

12. The assembly of claim 2, wherein the cutting edge of each of the at least one cutter bars faces in the same direction and the cutting edge of the raised cutting projection faces in an opposition direction such that the cutting edge of the projection faces the cutting edge of each cutter bar operation.

13. The assembly of claim 1, wherein the number of cutter bars is two.

14. A cutting assembly for a chopper pump having an intake end, the assembly comprising;

an intake end plate having a body defining an opening to allow the passage of material there through, wherein the intake end plate attaches at the intake end of the chopper pump;

at least one cutter bar projecting from the body of the intake end plate into the opening defined by the body of the intake end plate, each cutter bar comprising a cutting edge on an end, wherein the cutting edge of each cutter bar is formed at a junction between a first surface and an adjacent second surface, an impeller positioned at the intake end;

a nut positioned within the opening of the intake end plate, the nut comprising at least one raised cutting projection having a cutting edge formed at a junction between a first surface and an adjacent second surface, the cutting edge of the raised cutting projection providing cutting action in coordination with the cutting edge of each of the at least one cutter bars.

15. The assembly of claim 14, wherein the nut comprises a single raised cutting projection.

16. The assembly of claim 14, wherein the first surface and the adjacent second surface of the raised cutting projection form an angle within the range of 15 to 60 degrees.

17. The assembly of claim 14, wherein the first surface of each cutter bar is curved and the curve is cut to approximate an angle with the adjacent second surface of each cutter bar within the range of 15 to 60 degrees.

18. The assembly of claim 16, wherein the first surface of the raised cutting projection is curved.

19. The assembly of claim 17, wherein the approximated angle is about 45 degrees.

20. The assembly of claim 18, wherein the curve of the first surface is concave relative to the raised cutting projection.

21. The assembly of claim 19, wherein the curve of the first surface is concave relative to the cutting bar.

22. The assembly of claim 14, further comprising a recessed area adjacent the first surface opposite the second surface of the raised cutting projection.

23. The assembly of claim 14, wherein the cutting edge of each cutter bar faces in the same direction and the cutting edge of the raised cutting projection faces in an opposition direction such that the cutting edge of the projection faces the cutting edge of each cutter bar during operation.

* * * * *